United States Patent [19]

Greb

[11] Patent Number: 5,065,075

[45] Date of Patent: Nov. 12, 1991

[54] LAUNCHER SUITABLE FOR EXCITING SURFACE WAVES IN A DISCHARGE TUBE

[75] Inventor: Ulrich Greb, Cossington, England

[73] Assignee: Thorn EMI plc, London, England

[21] Appl. No.: 401,415

[22] Filed: Sep. 1, 1989

[30] Foreign Application Priority Data

Sep. 2, 1988 [GB] United Kingdom ..... 8821671

[51] Int. Cl.[5] ..... H05B 41/24

[52] U.S. Cl. ..... 315/248; 315/344; 313/607

[58] Field of Search ..... 315/111.21, 111.51, 315/248, 344, 39; 219/10.55 R; 313/607, 234

[56] References Cited

U.S. PATENT DOCUMENTS 4,049,940 9/1977 Moisan ..... 315/111.21
4,473,736 9/1984 Blotet ..... 315/111.21
4,715,054 12/1987 Kato ..... 315/111.21
4,792,725 12/1988 Levy ..... 315/111.21
4,906,898 3/1990 Moisan ..... 315/248

*Primary Examiner*—Eugene R. Laroche
*Assistant Examiner*—Amir Zarabian
*Attorney, Agent, or Firm*—Fleit, Jacobson, Cohn, Price, Holman & Stern

[57] ABSTRACT

A discharge tube arrangement for use as a light source includes a discharge tube made of a light-transmissive dielectric material and containing a fill. An excitation device for exciting surface waves in the discharge tube comprises an r.f. power generator and a launcher. The launcher is formed as an inner tube, an outer tube coaxial with the inner tube and first and second end walls, at least one of the first and second end walls having an aperture for receiving the discharge tube. A launcher gap extends axially from a first end of the inner tube and there is also a further gap. The outer tube and the first and second end walls form an unbroken electrically conductive path to provide an r.f. screening structure around the inner tube.

7 Claims, 4 Drawing Sheets

LAUNCHER SUITABLE FOR EXCITING SURFACE WAVES IN A DISCHARGE TUBE

BACKGROUND OF THE INVENTION

This invention relates to a discharge tube arrangement and in particular, though not exclusively, to such an arrangement for use as a light source. In particular, this invention relates to a structure, known as a launcher, for such a discharge tube arrangement.

It is known, e.g. as disclosed in U.S. Pat. No. 4,049,940 (Moisan et al), to generate and sustain a discharge in a gas by using electromagnetic surface waves. Surface waves are created by a launcher which is positioned around and external of, but not extending the whole length of, a discharge tube containing the gas. In such an arrangement, it is not necessary to provide electrodes inside the discharge tube. The power to generate the electromagnetic wave is provided by a radio frequency (r.f.) power generator.

For efficient power transfer from the power generator to the discharge tube, it is necessary to match the impedance of the power supply, the launcher and the discharge tube. M. Moisan and Z. Zakrzewski "New surface wave launchers for sustaining plasma columns at submicrowave frequencies (1-300 MHz)" *Rev. Sci. Instrum* 58 (10), October 1987, disclose a launcher with an impedance-matching network to provide what is termed 'external matching' (as opposed to 'internal matching' which would be provided by the size and shape of the launcher.) A typical launcher for use with an impedance-matching network is shown in FIG. 1. The launcher 2 comprises an inner aluminium tube 4 and an outer aluminium tube 6 coaxial with the inner tube 4. One end of the outer tube 6 is closed by a steel plate 8. The inner tube 4 is shorter than the outer tube 6 and accordingly an annular launching gap 10 is defined between the end of the inner tube 4 and the steel plate 8. At the other end of the launcher, an aluminium metal plate 12 extends perpendicularly from the inner tube 4 towards the outer tube 6 almost closing that end of the launcher. An annular field arresting gap 14 between the outer edge of the plate 12 and the outer tube 6 confines the field existing between the inner and outer tubes 4, 6. This gap allows a non-zero potential difference to be generated in the launching gap 10. A Telfon disc 15 adjacent the field arresting gap 14 holds the plate 12 and the inner tube 4 in position relative to the outer tube 6 and reduces, to a certain extent, the leakage of r.f. power from the field arresting gap 14. R.f. power is supplied to the launcher via a connector 16 and an impedance matching network (not shown) consisting of inductors and capacitors. The combination of the r.f. power generator, the impedance matching network and the launcher constitute an excitation device for the gas fill in the discharge tube.

A major problem with a discharge body arrangement incorporating such a launcher is the leakage of r.f. power, producing r.f. interference, from the field arresting gap 14. Moisan et al (ibid) teach that the field arresting gap must be small to minimise field leakage outside, but not so small as to allow r.f. arcing. The r.f. interference produced by the aforementioned launcher is significant—too great for a discharge tube arrangement intended, inter alia, for use as a domestic light source.

It is an object of the present invention to provide a launcher which at least alleviates the problem outlined hereinbefore.

SUMMARY OF THE INVENTION

According to the present invention there is provided a launcher suitable, when energised with radio frequency (r.f.) power, for exciting surface waves in a discharge tube containing a fill, the launcher comprising:

a) an inner tube having a first end and a second end;

b) an outer tube having a first end and a second end, said outer tube surrounding said inner tube and being mutually coaxially disposed on a longitudinal axis;

c) a first end wall extending substantially perpendicular to the longitudinal axis from said first end of said outer tube to a radially inward position disposed adjacent but axially spaced from the first end of said inner tube to form between said first end wall and said first end of the inner tube a launching gap, said first end wall having an aperture for receving a said discharge tube;

d) a second end wall extending from said second end of said outer tube to a radially inward position spaced axially from the second end of said inner tube to form a field arresting gap; wherein said outer tube and said first and second end walls form an unbroken electrically conductive path to provide an r.f. screening structure around said inner tube.

A launcher as defined in accordance with the present invention, when energised, produces an electromagnetic surface wave to generate and sustain a discharge in a discharge tube containing a fill. As the combination of the first and second end walls and the outer tube provides an r.f. screening structure around the inner tube, the r.f. interference produced by the excitation device is accordingly reduced.

BRIEF DESCRIPTION OF THE DRAWINGS

Embodiments of the invention will now be described, by way of example only, and with reference to the accompanying drawings in which.

DESCRIPTION OF PREFERRED EMBODIMENT

Figure 1:
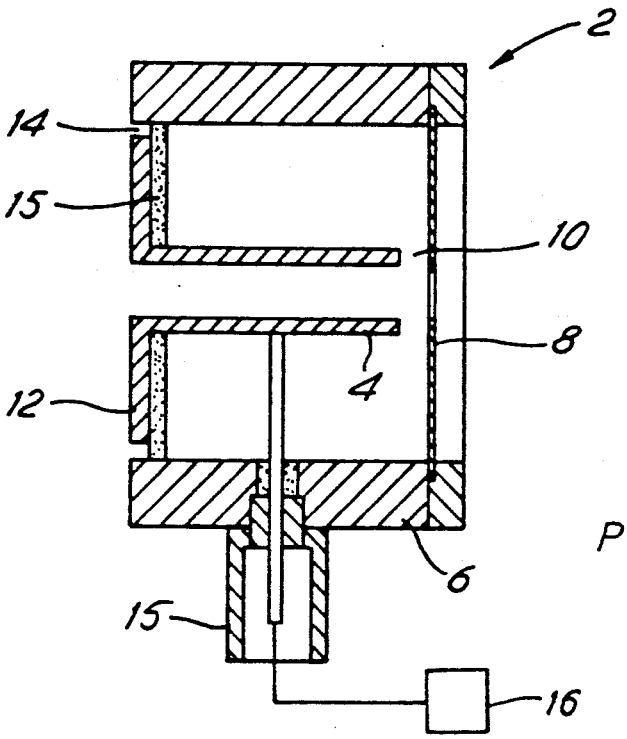
FIG. 1 PRIOR ART
FIG. 1 shows a cross-sectional side view of a known launcher as described hereinbefore.
Figure 2:
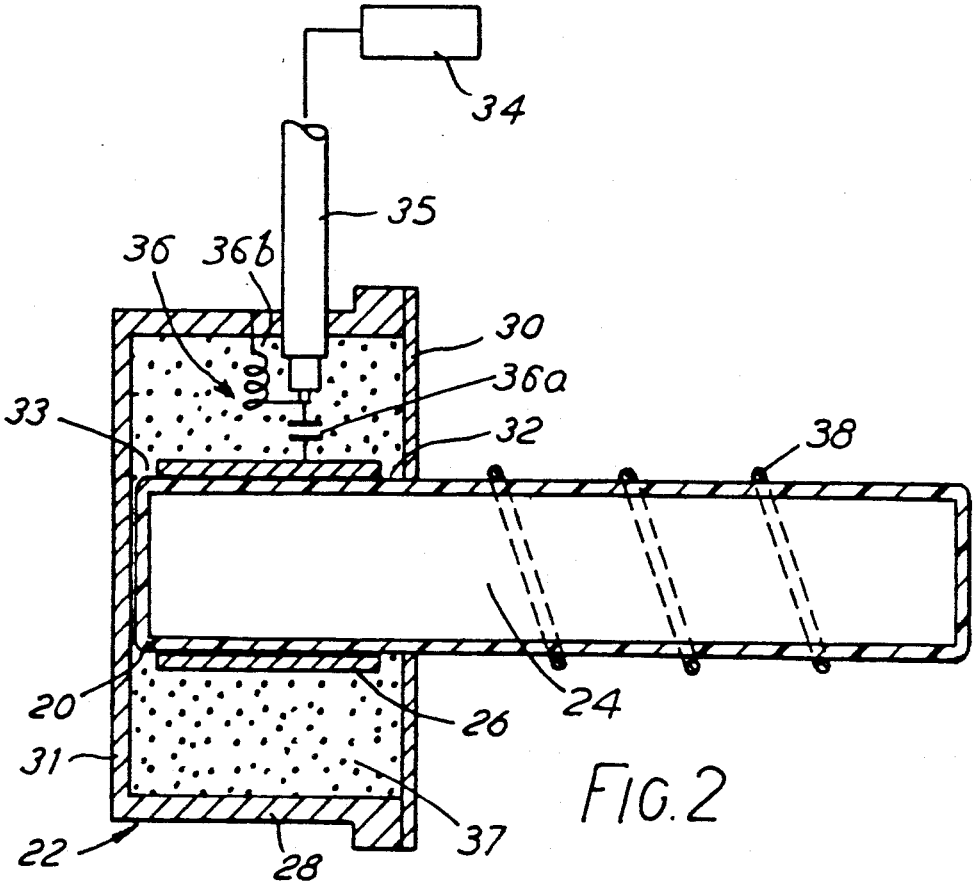
FIG. 2 shows a cross-sectional side view of a discharge tube arrangement incorporating a launcher provided in accordance with the present invention.

As shown in FIG. 2, a discharge tube arrangement comprises a discharge tube 20 mounted in a launcher 22. The discharge tube 20 is formed of a light-transmissive, dielectric material, such as glass, and contains a fill 24 of a noble gas, such as argon and an ionizable material, such as mercury.

The launcher 22 is made of an electrically conductive material, such as brass, and formed as a coaxial structure comprising an inner tube 26 and an outer tube 28. A first plate 30, at one end of the outer tube, provides a first end wall for the launcher structure. At the other end of the outer tube 28, a second plate 31, integral with the outer tube 28, provides a second end wall. The inner tube 26 is shorter than the outer tube 28 and so positioned within the outer tube 28 as to define a first annular gap 32 and a second annular gap 33. The first plate 30 has an aperture for receiving the discharge tube 20. The outer tube 28, the first plate 30 and the second plate 31 form an unbroken electrically conductive path around, but not in electrical contact with, the inner tube 26 to provide an r.f. screening structure therearound.

Suitable dimensions for the launcher of FIG. 2 are as follows:

| | |
|---|---|
| Launcher length | 7–20 mm |
| Launcher diameter (outer tube 28 diameter) | 25–35 mm but depends on size of discharge tube 20. |
| Inner tube 26 length | 3–18 mm |
| Inner tube 26 diameter | 13 mm but depends on size of discharge tube 20. |
| Length of Launching gap (first gap 32) | 0.5–3 mm |
| Length of second gap 33 | 1–10 mm |

The thickness of the electrically conductive material is of the order of millimeters, or less, depending on the construction method used.

An r.f. power generator 34 (shown schematically) is electrically connected to the launcher 22 via a coaxial cable 35 and an impedance matching network 36 (shown schematically) consisting of capacitors 36*a* and inductors 36*b*. The r.f. power generator 34, the impedance matching network 36, the coaxial cable 35 and the launcher 22 constitute an r.f. powered excitation device to energise the gas fill to produce a discharge.

A dielectric material 37 is provided inside the launcher 22 either as a structural element, e.g. to keep the size of the gaps 32, 33 constant and/or to hold the inner tube 26 in position, and/or to help in shaping the electric field in the gaps 32, 33 for ease of starting or other purposes. Suitable dielectric materials which exhibit low loss at r.f. frequencies include glass, quartz and PTFE.

When the r.f. power supply 34 is switched on, an oscillating electric field, having a frequency typically in the range of from 1 MHz to 1 GHz, is set up inside the launcher 22. At the first and second gaps 32, 33, this electric field is parallel to the longitudinal axis of the discharge tube 20. If sufficient power is applied, the consequent electric field produced in the gas fill 24 is sufficient to ionise the mercury to create a discharge through which an electromagnetic surface wave may be propagated in a similar manner to the arrangement of U.S. Pat. No. 4,049,940. Accordingly, the launcher 22 powered by the r.f. power generator 34 creates and sustains a discharge in the fill—the length and brightness of the discharge depending, inter alia, on the size of the discharge tube 20 and the power applied by the r.f. power generator 34. Such a discharge tube arrangement may therefore be used as a light source.

In the embodiment of FIG. 2, the first gap 32 and the second gap 33 each extend axially from respective ends of the inner tube 26, respectively to the first plate 30 and to the second plate 31. The discharge tube 20 extends from one end of the launcher 22 and so the first gap 32 is effective as a launching gap to create a discharge. The second gap 33 complements the effect of the first gap 32 and is advantageously larger than the first gap 32.

FIG. 2 also shows a helical structure 38, having 3 turns, and formed of an electrically conductive material, such as copper, extending along the discharge tube 20. An earth connection is provided from the structure 38 to the first plate 30 of the launcher 22. As disclosed in our copending GB Patent Application No. 8829251.1, the effect of the helical structure 38 is to enhance the light output of the discharge tube arrangement. The helical structure 38 also provides some r.f. screening.

Figure 3:
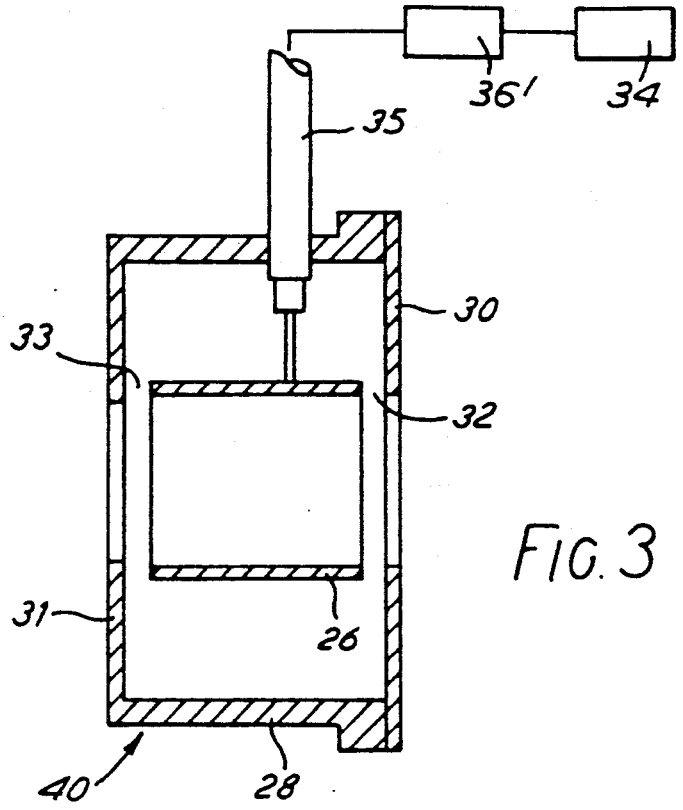
FIGS. 3, 4, 5*a*, 5*b*, 5*c*, 6*a* and 6*b* show cross-sectional side views of alternative embodiments of a launcher provided in accordance with the present invention.

FIG. 3 shows an alternative embodiment of a launcher provided in accordance with the present invention. The launcher 40 is formed as a coaxial structure in a similar manner to the launcher 22 of FIG. 2 and accordingly like parts are designated by like reference numerals. An aperture is also provided in the second plate 31 and accordingly the discharge tube (not shown) can be positioned to extend from both sides of the launcher 40. When power is supplied, both the first gap 32 and the second gap 33 are effective as launching gaps to create a discharge. If the first and second gaps 32, 33 are the same size, this results in a relatively symmetrical discharge. As with the embodiment of FIG. 2, the r.f. power at the second gap 33 is dissipated in the discharge and not lost from the system as in prior art launchers.

In the embodiment of FIG. 3, the inside of the launcher 22 is shown as not filled with dielectric material for simplicity. Dielectric material may be present or, alternatively, the cable 35 may be sufficient to hold the inner tube 26 in position. An impedance-matching network 36' is shown (schematically) outside the launcher 40.

Further embodiments of a launcher provided in accordance with the present invention are shown in FIGS. 4, 5*a*, 5*b*, 5*c* and 6*a*, 6*b*. Again, like parts are designated by like reference numerals.

Figure 4:
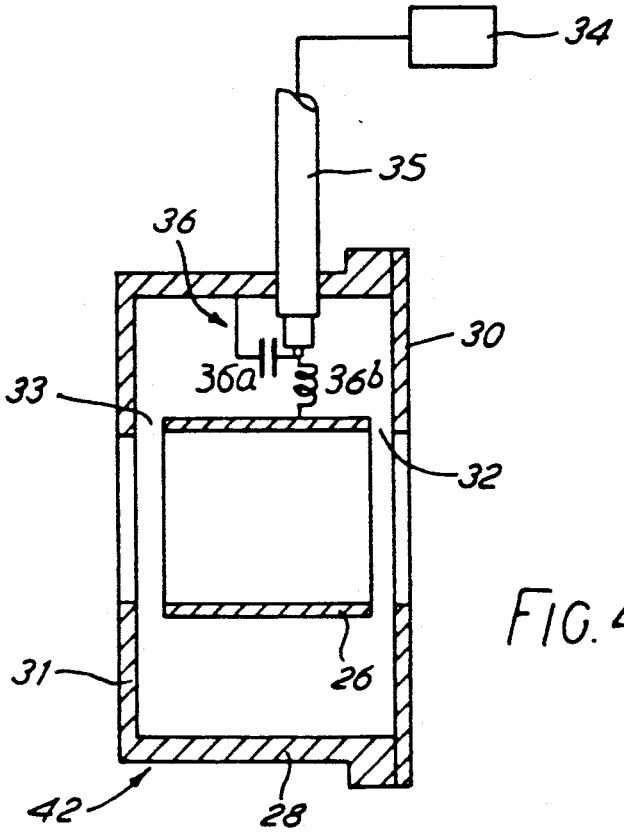

The embodiment of FIG. 4 is the embodiment of FIG. 3 modified so that the impedance matching network 36 (shown schematically) consisting of capacitors 36*a* and inductors 36*b* is provided inside the launcher—the coaxial cable 35 being connected directly to the r.f. power generator 34—thus providing a more compact light source. It is also envisaged that part or all of the r.f. power generator may be positioned inside the launcher.

Figure 5A:
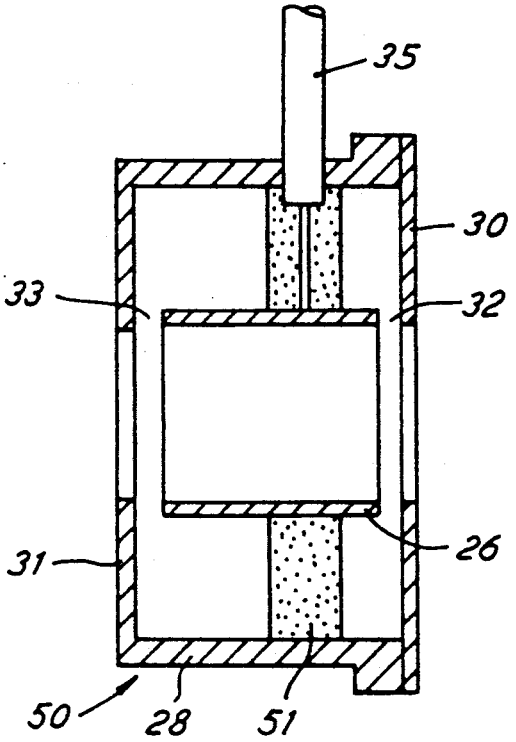
Figure 5B:
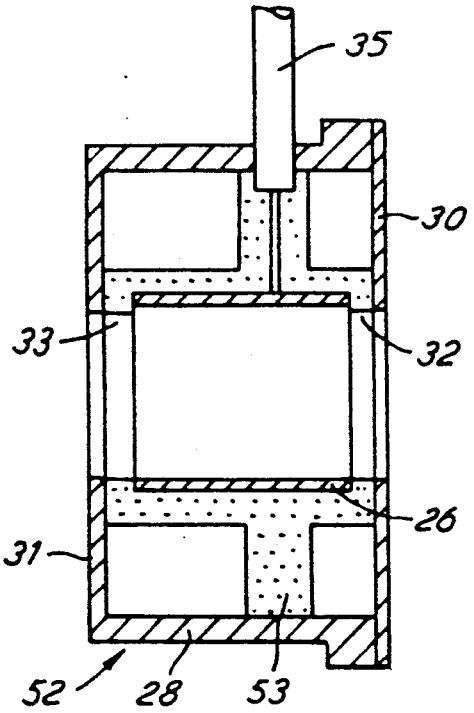
Figure 5C:
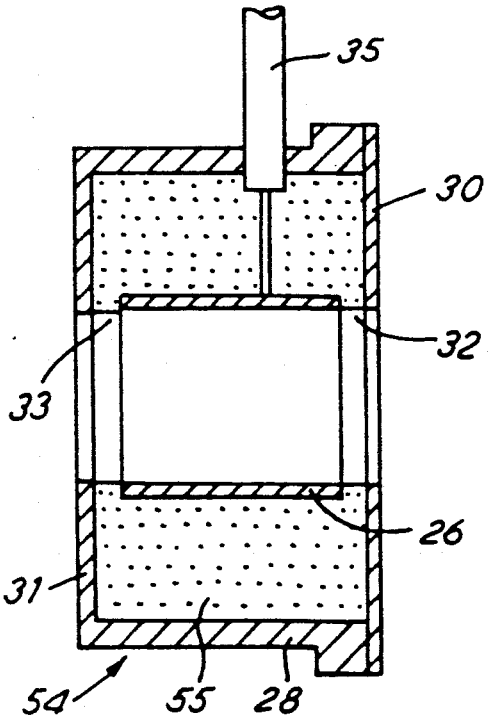

FIGS. 5*a*, 5*b* and 5*c* show a dielectric material 51, 53, 55 provided inside the launcher 50, 52, 54, either as a structural element e.g. to keep the size of the gaps 32, 33 constant and/or to hold the inner tube in position, and/or to help in shaping the electric field in the gaps 32, 33 for ease of starting or other purposes. As already indicated, suitable dielectric materials which exhibit low loss at r.f. frequencies include glass, quartz and PTFE. The impedance-matching network for these embodiments has not been shown.

Figure 6A:
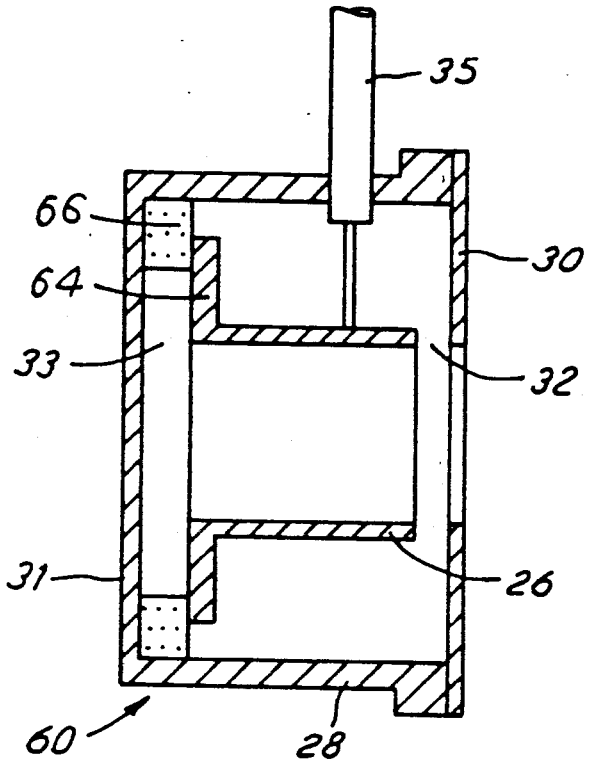
Figure 6B:
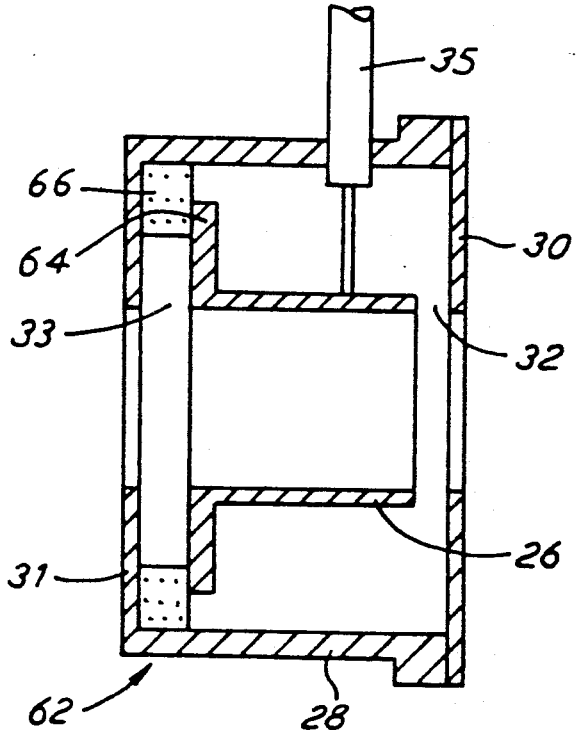

Launchers 60, 62 having a structure similar to the launchers 40 and 22 of FIGS. 2 and 3 are shown in FIGS. 6*a* and 6*b*. A major difference lies in the provision of a flange 64 at one end of the inner tube 26. The flange 64 extends radially towards, but is not in electrical contact with, the outer tube 28. An annular disc 66 of dielectric material assists in holding the inner tube 26 in position.

In the embodiments shown, the first and the second gap have each extended axially from a respective end of the inner tube of the launcher. It is envisaged that the first and second gaps can also be provided as a launching gap extending from one end of the inner tube and a further gap adjacent and extending radially outward from the other end of the inner tube. Such an embodiment would also provide an r.f. screening structure around the inner tube without the further gap necessarily being in a position to act as a launching gap.

Other modifications to the embodiments described herein and within the scope of the present invention will be apparent to those skilled in the art. In particular, it is envisaged that launcher structures need not be limited to those in which both the inner and the outer tube are of circular cross-section. The inner and outer tubes could be of non-circular but similar cross-section or could be of dissimilar cross-section.

I claim:

1. A launcher suitable when energised with radio frequency (r.f.) power for exciting surface waves in a discharge tube containing a fill, the launcher comprising:

a) an inner tube having a first end and a second end;

b) an outer tube having a first end and a second end, said outer tube surrounding said inner tube and being mutually coaxially disposed on a longitudinal axis;

c) a first end wall extending substantially perpendicular to the longitudinal axis from said first end of said outer tube to a radially inward position disposed adjacent but axially spaced from the first end of said inner tube to form between said first end wall and said first end of the inner tube a launching gap, said first end wall having an aperture for receiving a said discharge tube;

d) a second end wall extending from said second end of said outer tube to a radially inward position spaced axially from the second end of said inner tube to form a field arresting gap; wherein said outer tube and said first and second end walls form an unbroken electrically conductive path to provide an r.f. screening structure around said inner tube.

2. An excitation device for exciting surface waves in a discharge tube containing a fill, the excitation device comprising an r.f. power generator and a launcher suitable when energised with radio frequency (r.f.) power for exciting surface waves in a discharge tube containing a fill, the launcher comprising:

a) an inner tube having a first end and a second end;

b) an outer tube having a first end and a second end, said outer tube surrounding said inner tube and being mutually coaxially disposed on a longitudinal axis;

c) a first end wall extending substantially perpendicular to the longitudinal axis from said first end of said outer tube to a radially inward position disposed adjacent but axially spaced from the first end of said inner tube to form between said first end wall and said first end of the inner tube a launching gap, said first end wall having an aperture for receiving a said discharge tube;

d) a second end wall extending from said second end of said outer tube to a radially inward position spaced axially from the second end of said inner tube to form a field arresting gap; wherein said outer tube and said first and second end walls form an unbroken electrically conductive path to provide an r.f. screening structure around said inner tube.

3. A discharge tube arrangement for use in a light source comprising a discharge tube containing a fill, and an excitation device for exciting surface waves in said discharge tube, the excitation device comprising an r.f. power generator and a launcher suitable when energised with radio frequency (r.f.) power for exciting surface waves in a discharge tube containing a fill, comprising:

a) an inner tube having a first end and a second end;

b) an outer tube having a first end and a second end, said outer tube surrounding said inner tube and being mutually coaxially disposed on a longitudinal axis;

c) a first end wall extending substantially perpendicular to the longitudinal axis from said first end of said outer tube to a radially inward position disposed adjacent but axially spaced from the first end of said inner tube to form between said first end wall and said first end of the inner tube a launching gap, said first end wall having an aperture for receiving a said discharge tube;

d) a second end wall extending from said second end of said outer tube to a radially inward position spaced axially from the second end of said inner tube to form a field arresting gap; wherein said outer tube and said first and second end walls form an unbroken electrically conductive path to provide an r.f. screening structure around said inner tube.

4. A launcher according to claim 1 wherein said second end wall has aperture therein for receiving a said discharge tube.

5. A launcher according to claim 1 wherein said second end wall is formed integrally with said outer tube.

6. A launcher according to claim 1 wherein said inner tube and said outer tube have a similar cross-section.

7. A launcher according to claim 1 wherein at least one of said inner and said outer tubes has a circular cross-section.

* * * * *